US011239022B2

(12) United States Patent
Otsubo et al.

(10) Patent No.: US 11,239,022 B2
(45) Date of Patent: Feb. 1, 2022

(54) INDUCTOR COMPONENT MANUFACTURING METHOD AND INDUCTOR COMPONENT

(71) Applicant: Murata Manufacturing Co., Ltd., Kyoto (JP)

(72) Inventors: Yoshihito Otsubo, Kyoto (JP); Shinichiro Banba, Kyoto (JP); Mitsuyoshi Nishide, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 971 days.

(21) Appl. No.: 15/451,465

(22) Filed: Mar. 7, 2017

(65) Prior Publication Data

US 2017/0178796 A1 Jun. 22, 2017

Related U.S. Application Data

(63) Continuation of application No. PCT/JP2015/076850, filed on Sep. 24, 2015.

(30) Foreign Application Priority Data

Sep. 24, 2014 (JP) ..... JP2014-193523

(51) Int. Cl.
*H01F 27/02* (2006.01)
*H01F 27/29* (2006.01)
(Continued)

(52) U.S. Cl.
CPC ..... *H01F 27/29* (2013.01); *H01F 17/0013* (2013.01); *H01F 41/04* (2013.01); *H01F 41/041* (2013.01)

(58) Field of Classification Search
USPC ..... 336/83
See application file for complete search history.

(56) References Cited

U.S. PATENT DOCUMENTS 5,168,252 A 12/1992 Naito
6,362,716 B1 * 3/2002 Anbo ..... H01F 17/0013 336/200
(Continued)

FOREIGN PATENT DOCUMENTS

JP S60-011521 U 1/1985
JP H03-077416 U 8/1991
(Continued)

OTHER PUBLICATIONS

English translation of JP200796429 (Year: 2007).*
(Continued)

*Primary Examiner* — Ronald Hinson
(74) *Attorney, Agent, or Firm* — Pearne & Gordon LLP

(57) ABSTRACT

An inductor component includes an inductor electrode having two metal pins that form input and output terminals and a connecting conductor that connects one end of each of the metal pins to each other, the inductor electrode arranged such that other ends of the metal pins oppose each other, and a resin layer containing the inductor electrode such that other ends of the metal pins are exposed. The resin layer is formed having a single-layer structure. Variation in the characteristics of the inductor electrode can be reduced as compared to a case where the parts corresponding to the metal pins of the inductor electrode are formed as via conductors or through-hole conductors. Because the resin layer has a single-layer structure, stress acting on joint portions between the metal pins and the connecting conductor can be reduced, which makes it possible to improve the reliability of the inductor component.

4 Claims, 6 Drawing Sheets

(51) Int. Cl.
*H01F 17/00* (2006.01)
*H01F 41/04* (2006.01)

(56) References Cited

U.S. PATENT DOCUMENTS

| | | | | |
|---|---|---|---|---|
| 6,820,320 | B2 * | 11/2004 | Anbo | H01F 17/0013 29/602.1 |
| 7,884,695 | B2 * | 2/2011 | Mosley | H01F 17/0013 336/200 |
| 2010/0277267 | A1 * | 11/2010 | Bogert | H01F 3/10 336/221 |
| 2015/0235753 | A1 * | 8/2015 | Chatani | H01F 27/255 336/200 |

FOREIGN PATENT DOCUMENTS

| | | | |
|---|---|---|---|
| JP | H03-286614 | A | 12/1991 |
| JP | 2005183890 | A | 7/2005 |

OTHER PUBLICATIONS

International Search report issued in PCT/JP2015/076850 dated Dec. 15, 2015.
Written Opinion issued in PCT/JP2015/076850 dated Dec. 15, 2015.

* cited by examiner

INDUCTOR COMPONENT MANUFACTURING METHOD AND INDUCTOR COMPONENT

This is a continuation of International Application No. PCT/JP2015/076850 filed on Sep. 24, 2015 which claims priority from Japanese Patent Application No. 2014-193523 filed on Sep. 24, 2014. The contents of these applications are incorporated herein by reference in their entireties.

BACKGROUND

Technical Field

The present disclosure relates to an inductor component including an inductor electrode provided within an insulating layer.

Inductor components in which an inductor electrode is formed within an insulating layer have been known for some time. For example, as illustrated in FIG. 8, an inductor component 100 disclosed in Patent Document 1 includes an inductor electrode 102 provided within a multilayer substrate 101. Here, the multilayer substrate 101 is constituted of a multilayer body having a plurality of magnetic layers 101*a*. Meanwhile, the inductor electrode 102 includes in-plane conductors 103*a*-103*d* formed on one main surface of respective predetermined magnetic layers 101*a* and column-shaped conductors 104*a*-104*c* that connect the in-plane conductors 103*a*-103*d* between the layers, and is thus formed as a single conductor within the multilayer substrate 101. Being configured in this manner, the inductor electrode 102 functions as an inductor element.

Patent Document 1: Japanese Unexamined Patent Application Publication No. 2005-183890 (see paragraph 0051, FIG. 5, etc.)

BRIEF SUMMARY

In the case where the inductor electrode 102 is provided within the multilayer substrate 101, the column-shaped conductors 104*a*-104*c* are formed as via conductors or through-hole conductors in each magnetic layer 101*a*, and the inductor electrode 102 is formed by stacking these conductors in an overlapping manner. According to this method of forming the column-shaped conductors 104*a*-104*c*, lamination skew among the magnetic layers 101*a* results in a smaller connected surface area between adjacent conductors (via conductors or through-hole conductors). This increases the overall resistance value of the column-shaped conductors 104*a*-104*c*, which in turn increases the resistance value of the inductor electrode 102. Meanwhile, variation in lamination skew is a cause of variation in the resistance value of the inductor electrode 102. Furthermore, a smaller connected surface area between adjacent conductors (via conductors or through-hole conductors) results in an increased amount of heat emitted at the locations of the connections when current is applied, which reduces the reliability of the inductor electrode 102.

Having been achieved in light of the above-described problems, the present disclosure reduces variation in the characteristics of an inductor electrode and improves the reliability thereof in an inductor component in which an inductor electrode is provided within an insulating layer (a resin layer).

A method of manufacturing an inductor component according to the present disclosure includes: a preparation step of preparing an inductor electrode, the inductor electrode having first and second column-shaped conductors that form input and output terminals and a connecting conductor that connects one end of each of the first and second column-shaped conductors to each other, and the inductor electrode arranged such that other ends of the first and second column-shaped conductors oppose each other; a mounting step of mounting the other ends of the first and second column-shaped conductors to one main surface of a support plate; a resin layer forming step of laminating a resin layer onto the one main surface of the support plate such that the inductor electrode is embedded within the resin layer; and a removing step of removing the support plate so as to expose the other ends of the first and second column-shaped conductors from the resin layer. Here, the resin layer forming step forms the resin layer as a single-layer structure by embedding the first and second column-shaped conductors and the connecting conductor in resin all at once.

As described above, conventionally, a plurality of layers in each of which a part of the inductor electrode is formed have been prepared and laminated together so as to complete an inductor component that contains the inductor electrode. However, with the manufacturing method according to the present disclosure, the inductor component is manufactured by first completing the inductor electrode and then embedding the inductor electrode in resin all at once. Thus an increase in the resistance value of the inductor electrode, variations in the resistance value, and so on caused by lamination skew do not occur as in the conventional configuration. Furthermore, there is no decrease in the connected surface area between adjacent conductors (via conductors or through-hole conductors) caused by lamination skew. This makes it possible to prevent a drop in the reliability of the inductor component caused by heat emission when current is applied. Thus a highly-reliable inductor component, in which there is little variation in the characteristics of the inductor electrode, can be manufactured.

Meanwhile, the following may be carried out in the preparation step. A positioning jig is prepared, the positioning jig being divided into a plate-shaped positioning member and a plate-shaped cover member, and a first arrangement hole in which the first column-shaped conductor is arranged and a second arrangement hole in which the second column-shaped conductor is arranged being formed in one side surface that is formed by a dividing line between the positioning member and the cover member, such that the arrangement holes span the dividing line; and a first positioning member-side arrangement groove forming part of the first arrangement hole and a second positioning member-side arrangement groove forming part of the second arrangement hole are formed in a surface of the positioning member that opposes the cover member so as to reach the one side surface.

Then, a first cover member-side arrangement groove forming part of the remainder of the first arrangement hole and a second cover member-side arrangement groove forming part of the remainder of the second arrangement hole are formed in a surface of the cover member that opposes the positioning member so as to reach the one side surface; the first column-shaped conductor is disposed in the first positioning member-side arrangement groove of the positioning member such that one end of the first column-shaped conductor protrudes from the one side surface, and the second column-shaped conductor is disposed in the second positioning member-side arrangement groove such that one end of the second column-shaped conductor protrudes from the one side surface; the cover member is disposed relative to the positioning member such that the first positioning member-side arrangement groove and the first cover member-side arrangement groove face each other and the second positioning member-side arrangement groove and the second cover member-side arrangement groove face each other, and the first column-shaped conductor and the second column-shaped conductor are held in a state where the one ends of the first column-shaped conductor and the second column-shaped conductor protrude from the one side surface; a holding plate, to one main surface of which the connecting conductor is affixed, is prepared, and the one ends of the first and second column-shaped conductors are bonded to the connecting conductor using the holding plate; and the positioning jig is removed. Additionally, the holding plate may be removed after the mounting step.

Anchoring the first and second column-shaped conductors at predetermined positions and then connecting the one ends of the first and second column-shaped conductors to the connecting conductor can be considered as a method for preparing a completed inductor electrode constituted of the first and second column-shaped conductors and the connecting conductor. Here, a method in which two holes formed such that the one end portions of the column-shaped conductors can be inserted thereinto are provided in an anchoring jig, and the first and second column-shaped conductors are anchored by inserting those column-shaped conductors into the holes, can be given as a method of anchoring the column-shaped conductors. However, in the case where the column-shaped conductors are thin or long, it is difficult to insert the column-shaped conductors into the holes.

However, according to this configuration, the first and second arrangement holes that hold (anchor) the first and second column-shaped conductors are formed spanning the dividing line between the plate-shaped positioning member and the plate-shaped cover member. To rephrase, by dividing the arrangement holes with respect to a depth direction, the first and second positioning member-side arrangement grooves are formed in the positioning member and the first and second cover member-side arrangement grooves are formed in the cover member. In this case, when arranging the first and second column-shaped conductors in the first and second positioning member-side arrangement grooves of the positioning member, the column-shaped conductors can be disposed in a laid-down state, which makes the positioning easy even in the case where the column-shaped conductors are thin or long. Thus according to this configuration, it is easy to form the completed inductor electrode.

Additionally, the first column-shaped conductor and the second column-shaped conductor may be bonded to the connecting conductor using ultrasonic bonding. According to this configuration, connection resistance between the first and second column-shaped conductors and the connecting conductor can be reduced as compared to a case where the first and second column-shaped conductors and the connecting conductor are bonded by solder.

Meanwhile, an inductor component according to the present disclosure includes: an inductor electrode having first and second column-shaped conductors that form input and output terminals and a connecting conductor that connects one end of each of the first and second column-shaped conductors to each other, the inductor electrode arranged such that other ends of the first and second column-shaped conductors oppose each other; and a resin layer containing the inductor electrode such that other ends of the first and second column-shaped conductors are exposed. Here, the resin layer has a single-layer structure.

In the case where, for example, the first and second column-shaped conductors are constituted of via conductors or through-hole conductors obtained by forming through-holes in the resin layer, there are cases where the connecting conductor is first formed on the resin layer and another resin layer for protecting the connecting conductor is then laminated thereon. In this case, the process for forming a resin layer will be carried out multiple times, which increases the manufacturing cost of the inductor component. Additionally, if different types of resin are used to form the respective resin layers, stress will arise due to differences in setting shrinkage between the resins. There is a risk of this stress acting on the joint portions between the first and second column-shaped conductors and the connecting conductor and reducing the reliability of the inductor electrode. Even if the same type of resin is used, the resins have different levels of hardness before the overall setting process. There is thus a risk of stress arising due to differences in the amounts of setting shrinkage, and such stress leading to a drop in the reliability of the inductor electrode.

However, according to the present disclosure, the resin layer is formed having a single-layer structure, and thus the manufacturing cost of the inductor component can be reduced. Additionally, the above-described stress caused by setting shrinkage differences does not arise, and thus the reliability of the inductor component can be increased.

Additionally, the one ends of the first and second column-shaped conductors may be connected to the connecting conductor using ultrasonic bonding. In this case, connection resistance can be reduced as compared to a case where the first and second column-shaped conductors and the connecting conductor are bonded by solder.

Additionally, a plurality of the inductor electrodes may be provided, and the plurality of inductor electrodes may be arranged in a matrix within the resin layer. In this case, the reliability of an inductor component in which a plurality of inductor electrodes is arranged in a matrix can be increased.

According to the present disclosure, an inductor component is manufactured by first completing an inductor electrode and then embedding the inductor electrode in resin all at once. Thus an increase in the resistance value of the inductor electrode, variations in the resistance value, and so on caused by lamination skew do not occur as in the conventional configuration. Furthermore, there is no decrease in the connected surface area between adjacent conductors (via conductors or through-hole conductors) caused by lamination skew. This makes it possible to suppress a drop in the reliability of the inductor component caused by heat emission when current is applied. Thus a highly-reliable inductor component, in which there is little variation in the characteristics of the inductor electrode, can be manufactured.

DETAILED DESCRIPTION

First Embodiment

Figure 1:
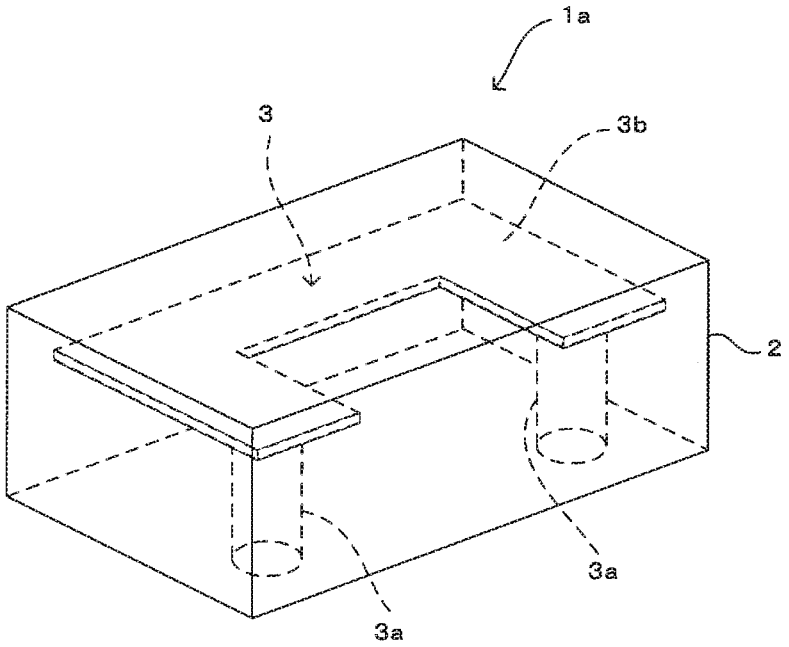
FIG. 1 is a perspective view of an inductor component according to a first embodiment of the present disclosure.

An inductor component 1*a* according to an embodiment of the present disclosure will be described with reference to FIG. 1. FIG. 1 is a perspective view of the inductor component 1*a*.

As illustrated in FIG. 1, the inductor component 1*a* according to this embodiment includes a resin layer 2 and an inductor electrode 3 provided within the resin layer 2, and the inductor component 1*a* is mounted onto the motherboard or the like of an electronic device, for example.

The inductor electrode 3 includes two metal pins 3*a* (corresponding to "first and second column-shaped conductors" according to the present disclosure) that form input and output terminals, and a connecting conductor 3*b* that connects one end of each of the metal pins 3*a* to each other. The metal pins 3*a* are erected along a thickness direction of the resin layer 2 such that other ends thereof are opposite each other. Here, the metal pins 3*a* are arranged so as to be substantially parallel, with the surfaces of the other ends thereof exposed on a lower surface of the resin layer 2. The other end surfaces are used as outer electrodes for input and output. The metal pins 3*a* are obtained by subjecting a wire material, formed from a metal such as Cu, a Cu alloy such as a Cu—Ni alloy, or Fe, to a shearing process. Meanwhile, the other ends of the metal pins 3*a* opposing each other refers to a state in which both of the other ends of the metal pins 3*a* are located on the same side relative to the connecting conductor 3*b* in the thickness direction of the resin layer 2, as in the case where the metal pins 3*a* are disposed such that the surfaces of the other ends thereof are both exposed on the lower surface of the resin layer 2. This excludes an arrangement in which, for example, the surface of the other end of one of the metal pins 3*a* is exposed on the lower surface of the resin layer 2 and the surface of the other end of the other metal pin 3*a* is exposed on an upper surface of the resin layer 2.

The connecting conductor 3*b* is formed from a material typically used to form a wire electrode, such as Cu or Al. The connecting conductor 3*b* is formed having a predetermined patterned shape such that a desired inductance can be achieved. Note that the connecting conductor 3*b* may be a metal foil in sheet form, or may be a metal pin that has been bent.

The resin layer 2 contains the inductor electrode 3 with the other ends of the metal pins 3*a* being exposed. The resin layer 2 is formed from a magnetic body-containing resin obtained by mixing an insulative thermosetting resin such as epoxy resin with a magnetic body filler such as ferrite powder. In the case where the above-described inductor electrode 3 is provided within the resin layer 2, a method in which the resin layer 2 is given a multilayer structure and conductors, instead of the metal pins 3*a*, are formed by overlapping via conductors formed in the respective layers with each other is typically employed. In this case, lamination skew in the layers causes changes in the connected surface area of adjacent via conductors and increases the resistance value of the inductor electrode as a whole. Additionally, positional variation in the lamination skew is a cause of variation in the resistance value of the inductor electrode. As such, according to this embodiment, the metal pins 3*a* are employed instead of the via conductors that have been employed in the past. Doing so provides a configuration in which the resistance value of the inductor electrode 3 as a whole does not increase and the resistance value does not vary.

With the structure of the inductor electrode 3 described above, there are cases where the metal pins 3*a* are embedded in the resin layer 2, both end portions thereof are exposed through polishing, grinding, or the like, and the connecting conductor 3*b* is then formed on an upper surface of the resin layer 2 (that is, a main surface on which the upper ends of the metal pins 3*a* are exposed). Providing another resin layer on the upper surface of the resin layer 2 can be considered for the purpose of protecting the connecting conductor 3*b*, and the resin layer 2 will have a multilayer structure in such a case. In the case where the resin layer 2 has a multilayer structure, the process for forming a resin layer will be carried out multiple times, which increases the manufacturing cost. Additionally, if different types of resin are used to form the respective resin layers, stress will arise due to differences in setting shrinkage between the resins. There is a risk of this stress acting on the joint portions between the metal pins 3*a* and the connecting conductor 3*b* and reducing the reliability of the inductor electrode 3. Accordingly, in this embodiment, the resin layer 2 is formed having a single-layer structure in order to suppress the above-described increase in manufacturing cost and drop in reliability.

(Inductor Component Manufacturing Method)

Figure 2A:
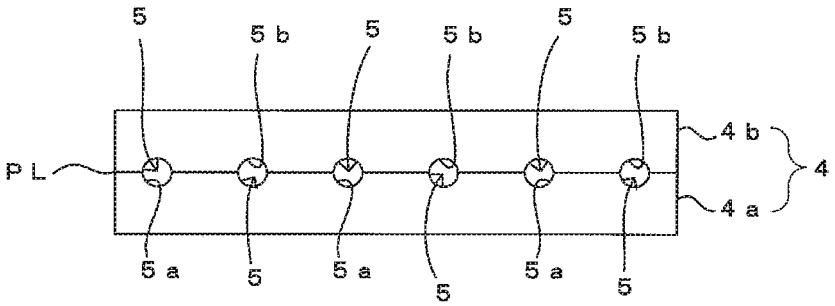
FIGS. 2A-2C are diagrams illustrating the structure of a positioning jig.
Figure 2B:
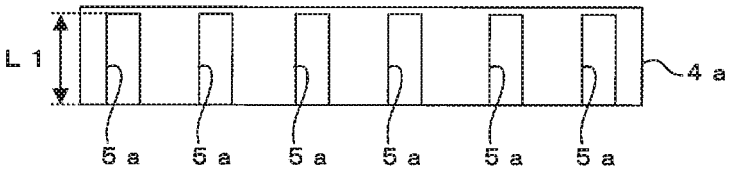
Figure 2C:
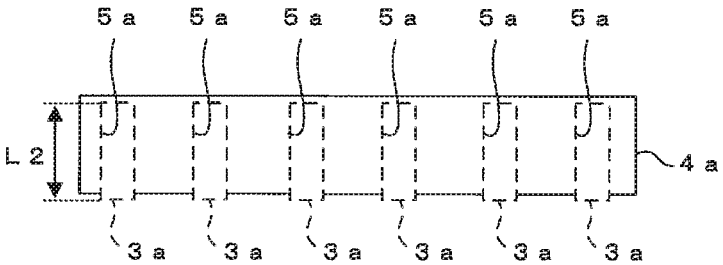

Next, a method of manufacturing the inductor component la will be described with reference to FIGS. 2A to 4F. FIGS. 2A-2C are diagrams illustrating the structure of a positioning jig 4 for positioning the metal pins 3*a*, whereas FIGS. 3 and 4 are diagrams illustrating the method of manufacturing the inductor component 1*a*. Here, FIG. 2A is a front view of the positioning jig, FIG. 2B is a plan view of a positioning member 4*a*, and FIG. 2C is a plan view of the positioning member 4*a* in a state where the metal pins 3*a* have been disposed in the positioning member 4*a*. FIGS. 3A to 3F illustrate individual steps in the method of manufacturing the inductor component 1*a*, and FIGS. 4A to 4F indicate individual steps that follow the step illustrated in FIG. 3F. Note that this embodiment describes a case where a collection of a plurality of (three, in this embodiment) inductor components 1*a* are formed together as a collection and then separated into individual inductor components 1*a* as an example of the method of manufacturing the inductor component 1*a*. Note that the manufacturing method described hereinafter can also be applied to methods of manufacturing inductor components 1*b* and 1*c* according to other embodiments.

First, the positioning jig 4 for positioning the metal pins 3*a* in predetermined positions, illustrated in FIGS. 2A-2C, is prepared. The positioning jig 4 is formed of the positioning member 4*a* and a cover member 4*b*, which are separate plate-shaped members. As illustrated in FIG. 2A, a plurality of arrangement holes 5 (corresponding to "first and second arrangement holes" according to the present disclosure) in which the metal pins 3*a* are arranged are formed in one side surface of the positioning member 4*a* and the cover member 4*b*, where a dividing line PL is formed. In this case, the arrangement holes 5 are formed so as to span the dividing line PL.

Specifically, as illustrated in FIG. 2B, a plurality of positioning member-side arrangement grooves 5*a* (corresponding to "first and second positioning member-side arrangement grooves" according to the present disclosure) that form parts of the arrangement holes 5 are formed in the surface of the positioning member 4*a* that faces the cover member 4*b*. Each positioning member-side arrangement groove 5*a* is formed so that one end thereof reaches the one side surface of the positioning jig 4. In other words, one end of each positioning member-side arrangement groove 5*a* is open and thus forms part of an opening of the corresponding arrangement hole 5, whereas the other end is closed and forms part of a base portion of the corresponding arrangement hole 5. Each positioning member-side arrangement groove 5*a* is formed as a linear groove, and a length L1 hereof is formed so as to be slightly shorter than a length L2 of the metal pins 3*a* (L1<L2).

On the other hand, a plurality of cover member-side arrangement grooves 5*b* (corresponding to "first and second cover member-side arrangement grooves" according to the present disclosure) that form parts of the remainders of the arrangement holes 5 are formed in the surface of the cover member 4*b* that faces the positioning member 4*a*. Each cover member-side arrangement groove 5*b* forms a pair with a corresponding positioning member-side arrangement groove 5*a*, and is formed having the same shape as the positioning member-side arrangement groove 5*a* with which the pair is formed. The arrangement holes 5 are formed in the positioning jig 4 by disposing the cover member 4*b* with respect to the positioning member 4*a* such that the positioning member-side arrangement grooves 5*a* and the cover member-side arrangement grooves 5*b* that form pairs with each other face each other.

Figure 3A:
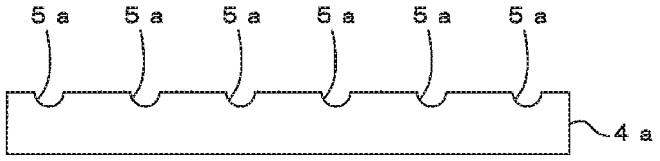
FIGS. 3A-3F are diagrams illustrating a method of manufacturing the inductor component illustrated in FIG. 1.

After the positioning jig 4 formed as described above is prepared, the positioning member 4*a* is arranged such that a main surface thereof in which the positioning member-side arrangement grooves 5*a* are formed (that is, the surface facing the cover member 4*b*) faces upward, as illustrated in FIG. 3A.

Figure 3B:
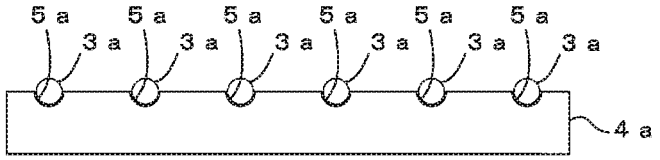

Next, the metal pins 3*a* are disposed in the positioning member-side arrangement grooves 5*a* in a laid-down state, as illustrated in FIG. 3B. The positioning member-side arrangement grooves 5*a* are formed such that the length L1 thereof is shorter than the length of the metal pins 3*a*, and thus in this case, the metal pins 3*a* are disposed such that one end of each metal pin 3*a* protrudes from the corresponding positioning member-side arrangement groove 5*a* (from the one side surface of the positioning jig 4). Note that with this configuration, the metal pins 3*a* can be disposed in a laid-down state, and can therefore be disposed in the positioning member-side arrangement grooves 5*a* with ease even in the case where the metal pins 3*a* are long.

Figure 3C:
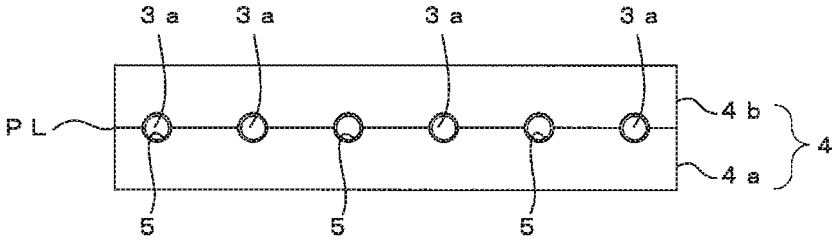

Next, the cover member 4*b* is arranged with respect to the positioning member 4*a* such that the positioning member-side arrangement grooves 5*a* and the cover member-side arrangement grooves 5*b* that form pairs face each other, and as a result, the metal pins 3*a* are held in the corresponding arrangement holes 5 of the positioning jig 4, as illustrated in FIG. 3C. In this case, the positioning jig 4 holds the metal pins 3*a* with the one end of each metal pin 3*a* protruding from the one side surface of the positioning jig 4.

Figure 3D:
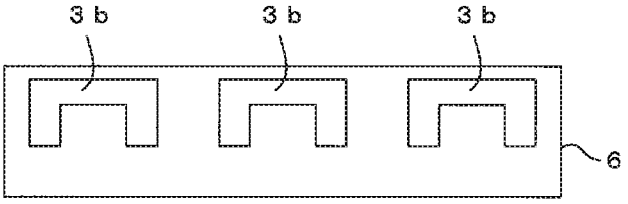

Next, a holding plate 6, formed from a resin or the like and to which a plurality of connecting conductors 3*b* having a desired shape are affixed, is prepared, as illustrated in FIG. 3D. In this case, an adhesive layer (not illustrated) is formed on the surface of the holding plate 6 to which the connecting conductors 3*b* are affixed. Here, for example, the connecting conductors 3*b* may be formed by affixing a metal plate formed from Cu or the like to the holding plate 6 and then processing the metal plate into the desired shape using a technique such as photolithography, or connecting conductors 3*b* that have already been processed into the desired shape may be affixed to the holding plate 6.

Figure 3E:
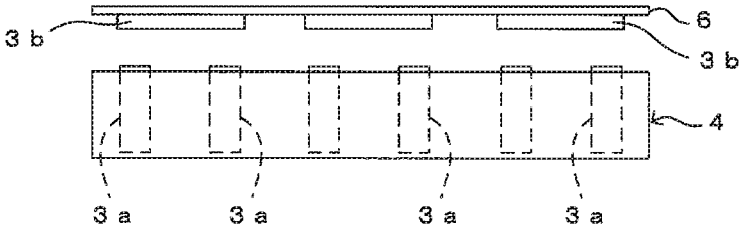

Next, the positioning jig 4, which holds the metal pins 3*a* in a laid-down state, is moved such that the metal pins 3*a* are in a standing state, as illustrated in FIG. 3E. At this time, the positioning jig 4 is moved such that the one ends of the metal pins 3*a* face upward.

Figure 3F:
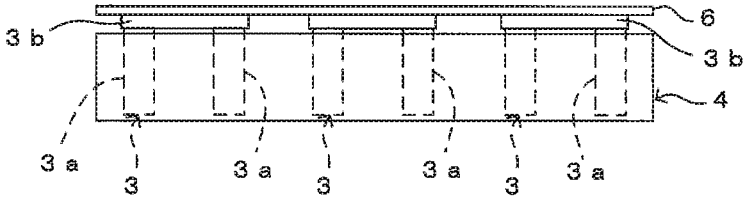

Next, using the holding plate 6 to which the connecting conductors 3*b* are affixed, each connecting conductor 3*b* is bonded to the one ends of two of the metal pins 3*a* that form input and output terminals, respectively, as illustrated in FIG. 3F. In this case, the metal pins 3*a* and the connecting conductors 3*b* are bonded through ultrasonic bonding such that each connecting conductor 3*b* connects the one ends of two metal pins 3*a* disposed adjacent to each other. As a result of this bonding, a plurality of (three, in this embodiment) inductor electrodes 3 are formed, each inductor electrode 3 having two metal pins 3*a* that form input and output terminals, respectively, and the connecting conductor 3*b* connecting the one ends of those metal pins 3*a* to each other, and with the other ends of the metal pins 3*a* opposing each other. In the present embodiment, the above-described process from FIGS. 3A to 3F corresponds to a "preparation step" according to the present disclosure.

Here, the positioning jig 4 holds the metal pins 3*a* with the one end of each metal pin 3*a* protruding from the one side surface of the positioning jig 4. This makes it easy to carry out the ultrasonic bonding between the metal pins 3*a* and the connecting conductors 3*b*. Note that the bonding between the metal pins 3*a* and the connecting conductors 3*b* is not limited to ultrasonic bonding; for example, solder bonding may be used instead.

Figure 4A:
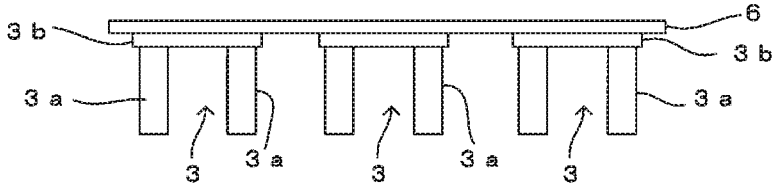
FIGS. 4A-4F are diagrams illustrating a method of manufacturing the inductor component illustrated in FIG. 1.

Next, the positioning jig 4 that held the metal pins 3*a* is removed, as illustrated in FIG. 4A. Specifically, the holding plate 6 is separated from the positioning jig 4 such that the metal pins 3*a* bonded to the connecting conductors 3*b* pull out therefrom.

Figure 4B:
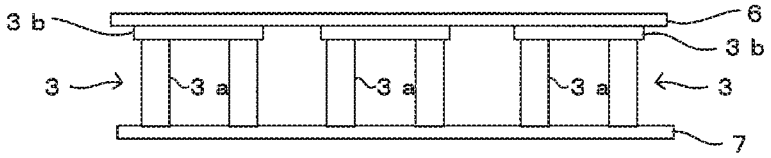

Next, the other ends of the metal pins 3*a* are mounted to one main surface of a support plate 7 (this corresponds to a "mounting step" according to the present disclosure), as illustrated in FIG. 4B. The support plate 7 can be formed from a resin or the like, and an adhesive layer (not illustrated) is formed on the one main surface thereof.

Figure 4C:
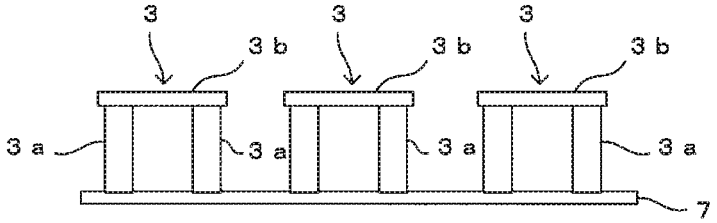

Next, the holding plate 6 used to form the inductor electrodes 3 is removed, as illustrated in FIG. 4C.

Figure 4D:
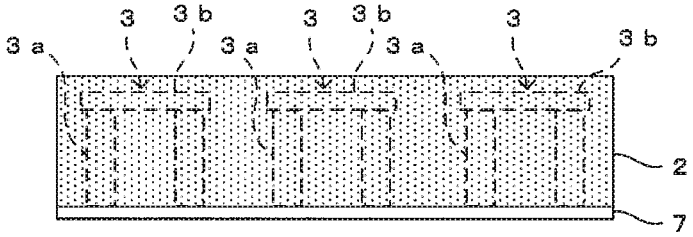

Next, the resin layer 2 is laminated onto the one main surface of the support plate 7 such that the inductor electrodes 3 are embedded therein (this corresponds to a "resin layer forming step" according to the present disclosure), as illustrated in FIG. 4D. In this case, the metal pins 3*a* and the connecting conductors 3*b* that form the inductor electrodes 3 are embedded in the resin all at once, and thus the resin layer 2 is formed having a single-layer structure. Note that the resin layer 2 can be formed through a coating method, a printing method, a compression molding method, a transfer molding method, or the like.

Figure 4E:
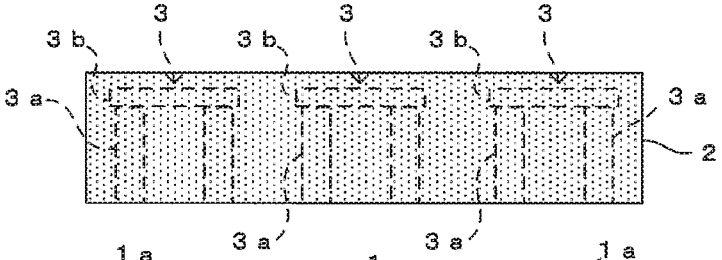

Next, the support plate 7 is removed so as to expose the other ends of the metal pins 3*a* from the lower surface of the resin layer 2 (this corresponds to a "removing step" according to the present disclosure), as illustrated in FIG. 4E. In this case, the support plate 7 may be peeled away from the resin layer 2, or the support plate 7 may be removed through polishing, grinding, or the like.

Figure 4F:
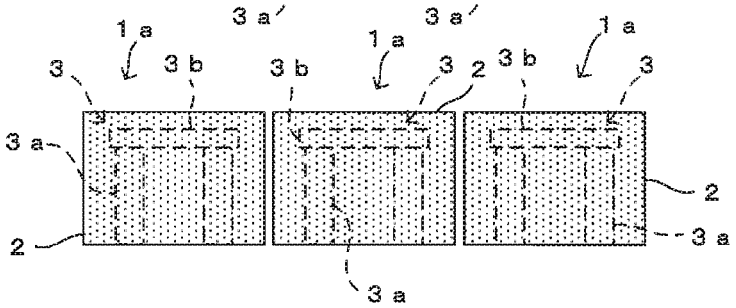

Finally, the individual inductor components 1*a* are completed by cutting the collection with a dicing machine, as illustrated in FIG. 4F.

Thus according to the embodiment described thus far, with the manufacturing method according to the present disclosure, the inductor electrodes 3 is completed first, after which the inductor component 1*a* is manufactured by embedding those inductor electrodes 3 in a resin all at once, unlike the conventional technique, in which a plurality of layers are prepared with each layer containing part of the inductor electrode and those layers are then laminated together to complete an inductor component containing the inductor electrode therein. As such, an increase in the resistance value of the inductor electrode 3, variations in the resistance value, and so on caused by lamination skew do not occur as in the conventional configuration. Furthermore, there is no decrease in the connected surface area between adjacent conductors (via conductors or through-hole conductors) caused by lamination skew. This makes it possible to suppress a drop in the reliability of the inductor component 1*a* caused by heat emission when current is applied. Thus a highly-reliable inductor component 1*a*, in which there is little variation in the characteristics of the inductor electrodes 3, can be manufactured.

In the case where the portions corresponding to the metal pins 3*a* of the inductor electrodes 3 are formed as column-shaped conductors such as via conductors or through-hole conductors, the column-shaped conductors cannot be formed with precision, and it is easy for flaws to arise in the interiors thereof. In such a case, the specific resistances of the column-shaped conductors will rise, and variation therebetween will increase. It also becomes difficult to keep the resistance values of the inductor electrodes 3 within a desired range. Furthermore, conductors having such flawed parts emit heat easily when current is applied, leading to a risk that the reliability of the inductor component 1*a* will drop. However, in the case where each inductor electrode 3 is partially constituted by the metal pins 3*a* as in this embodiment, the inductor electrode 3 can be formed with a higher level of precision than when using via conductors or through-hole conductors, and furthermore, the specific resistance can be lowered, variations therein can be reduced, and there are also fewer flawed parts. Using the metal pins 3*a* as parts of the inductor electrode 3 thus makes it possible to provide an inductor component 1*a* that has a low resistance value for the inductor electrode 3 as a whole, low variations among the resistance values, and furthermore is highly reliable.

Additionally, according to the method of manufacturing the inductor component 1*a* described above, the metal pins 3*a* can be disposed in the positioning member-side arrangement grooves 5*a* of the positioning member 4*a* in a laid-down state, which makes the positioning easy even in the case where the metal pins 3*a* are thin or long (for example, compared to a method in which the metal pins are positioned while in a standing state, there is no risk of the metal pins tilting, and it is easy to position both the ends of the metal pins). It is thus easy to form the completed inductor electrodes 3.

Finally, the metal pins 3*a* and the connecting conductors 3*b* are bonded to each other through ultrasonic bonding, and thus connection resistance between the metal pins 3*a* and the connecting conductors 3*b* can be reduced as compared to a case where the metal pins 3*a* and the connecting conductors 3*b* are bonded by solder.

Second Embodiment

Figure 5:
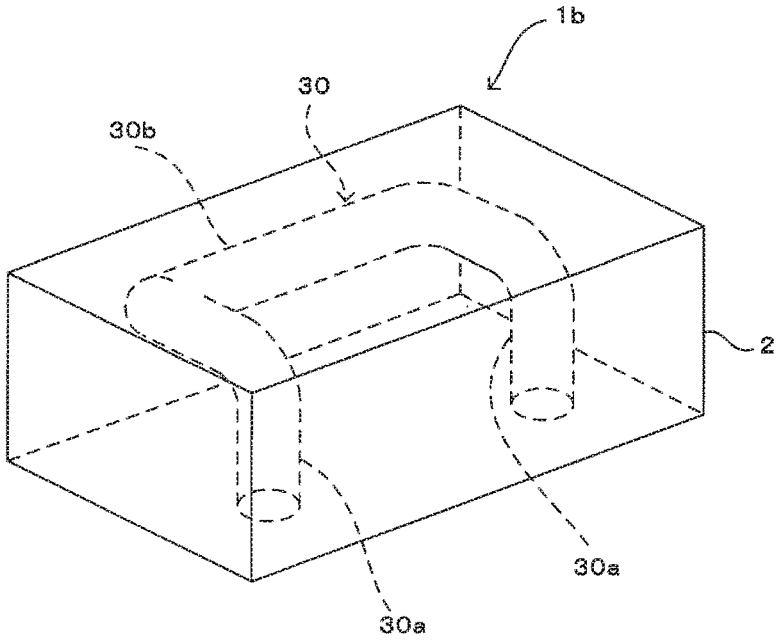
FIG. 5 is a perspective view of an inductor component according to a second embodiment of the present disclosure.

An inductor component 1*b* according to a second embodiment of the present disclosure will be described with reference to FIG. 5. FIG. 5 is a perspective view of the inductor component 1*b*.

The inductor component 1*b* according to this embodiment differs from the inductor component 1*a* according to the first embodiment described with reference to FIG. 1 in that, as illustrated in FIG. 5, two metal pins 30*a* that form input and output terminals of an inductor electrode 30 are formed integrally with a connecting conductor 30*b* that connects one end of each of the metal pins 30*a* to each other. The rest of the configuration is the same as that of the inductor component 1*a* according to the first embodiment, and thus descriptions thereof will be omitted by assigning the same reference numerals.

In this case, the inductor electrode 30 is formed by bending a single metal pin. This configuration makes it unnecessary to carry out a process for bonding the metal pins 30*a* and the connecting conductor 30*b* in the process of manufacturing the inductor electrode 30. Furthermore, because the inductor electrode 30 is formed from a single metal pin in which there are no joint portions between the metal pins 30*a* and the connecting conductor 30*b*, there is no increase in the resistance value caused by such joint portions. As a result, the resistance value of the inductor electrode 30 as a whole is reduced, and variations therein are reduced as well. Furthermore, less heat is emitted when current is applied, and thus the reliability of the inductor component 1*b* can be increased. Note that the inductor electrode 30 can be formed from the same material as that of the metal pins 3*a* used in the first embodiment. Note also that a process of forming the inductor electrode 30 by bending the single metal pin described above corresponds to a "preparation step" in the process of manufacturing the inductor component 1*b*.

Third Embodiment

Figure 6:
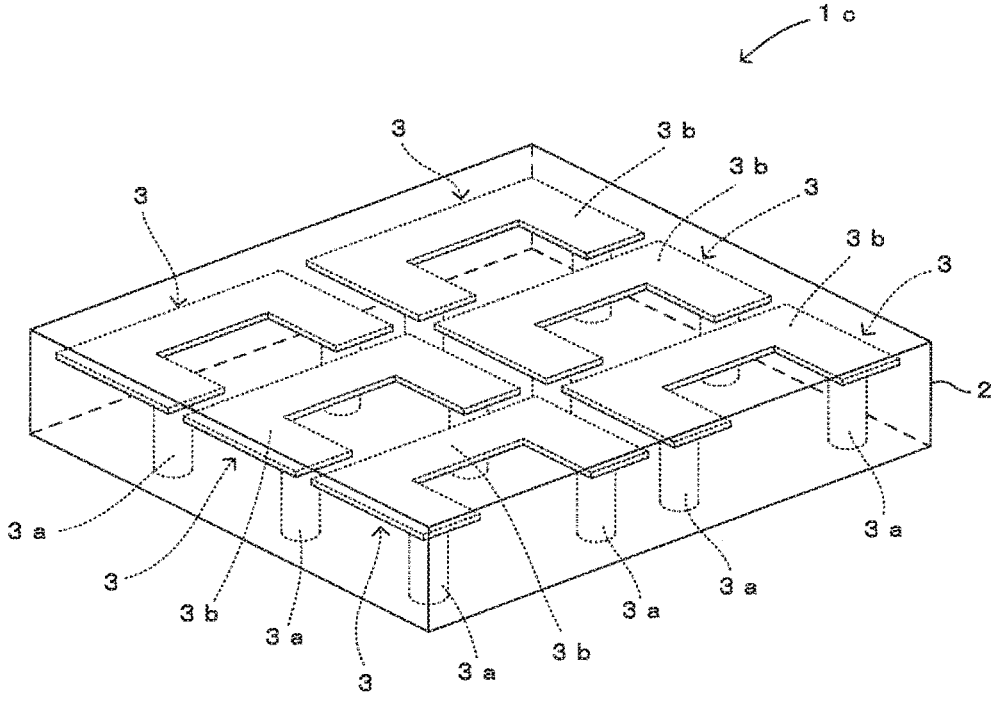
FIG. 6 is a perspective view of an inductor component according to a third embodiment of the present disclosure.

An inductor component 1*c* according to a third embodiment of the present disclosure will be described with reference to FIG. 6. FIG. 6 is a perspective view of the inductor component 1*c*.

The inductor component 1*c* according to this embodiment differs from the inductor component 1*a* according to the first embodiment described with reference to FIG. 1 in that, as illustrated in FIG. 6, a plurality of inductor electrodes 3 are embedded in the resin layer 2. The rest of the configuration is the same as that of the inductor component 1*a* according to the first embodiment, and thus descriptions thereof will be omitted by assigning the same reference numerals.

In this case, six inductor electrodes 3 are arranged in a matrix within the resin layer 2, forming an inductor array structure. The other end of each metal pin 3*a* is exposed on the lower surface of the resin layer 2, and these other ends function as input and output terminals for external connections.

According to this configuration, via conductors or through-hole conductors are not formed in the areas corresponding to the metal pins 3*a*, as is the case in conventional inductor array structures. As such, the parts corresponding to the input and output terminals (that is, the metal pins 3*a*) can be formed in a precise manner. Additionally, there are no internal flaws in those areas (the areas corresponding to the input and output terminals), such as unfilled parts, unplated parts, areas of lamination skew, and so on in the conductors, which arise in the case of via conductors. As a result, the distance between inductor electrodes 3 can be shortened as compared to the conventional inductor array structure, and thus the inductor component 1*c* can be made smaller. Additionally, the specific resistance of the inductor electrode 3 as a whole can be reduced, and variations therein can be reduced as well. Furthermore, the amount of heat emitted when current is applied can be reduced, and thus the reliability of the inductor component 1*c* can be increased.

Figure 7:
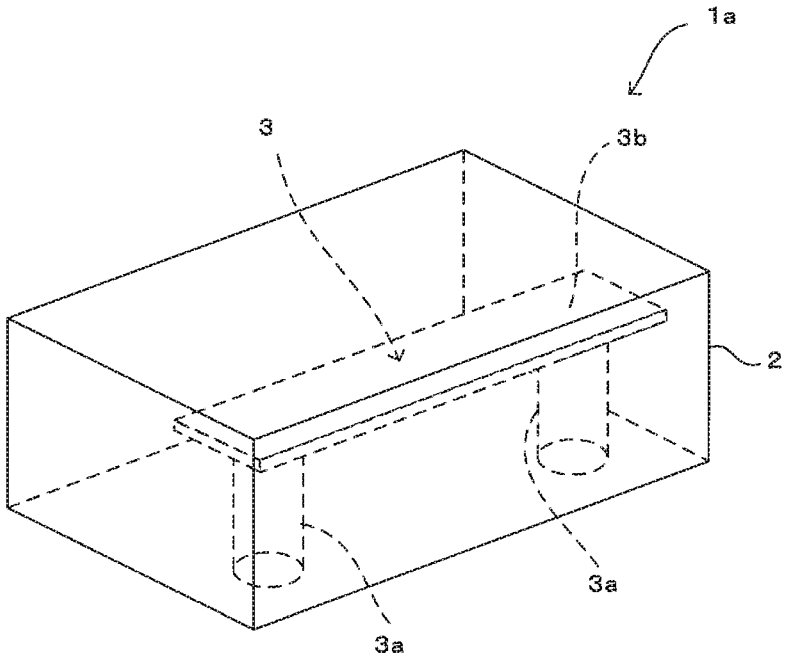
FIG. 7 is a diagram illustrating a variation on an inductor electrode.
Figure 8:
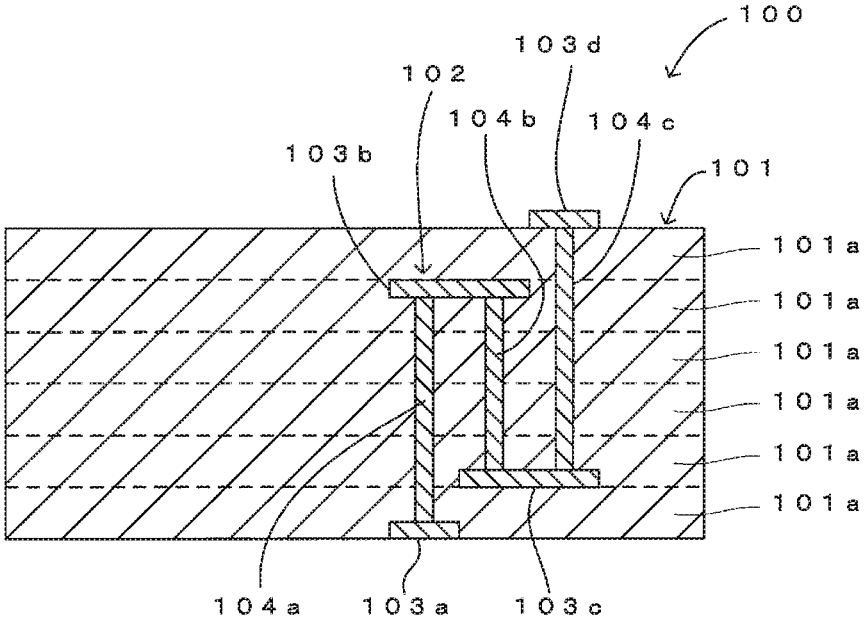
FIG. 8 is a cross-sectional view of a conventional inductor component.

Note that the present disclosure is not intended to be limited to the above-described embodiments, and many changes aside from the content described above can be made without departing from the spirit of the present disclosure. For example, in the above-described embodiments, the connecting conductors 3*b* and 30*b* that connect the corresponding one ends of the metal pins 3*a* and 30*a* may be formed having linear shapes, as illustrated in FIG. 7. Note that FIG. 7 is a diagram illustrating a variation on the inductor electrode, and illustrates a case where the connecting conductor 3*b* of the inductor component 1*a* according to the first embodiment is formed having a linear shape as an example.

Additionally, although the method of manufacturing the inductor component 1*a* described above discusses a case where a collection of inductor components 1*a* is first formed and then divided into individual inductor components 1*a* as an example, a single inductor component 1*a* may be formed through the same manufacturing method.

Furthermore, the configuration may be such that the resin layer 2 does not contain a magnetic body filler.

INDUSTRIAL APPLICABILITY

The present disclosure can be applied broadly in various inductor components in which an inductor electrode is provided within a resin layer.

REFERENCE SIGNS LIST

1*a*-1*c* INDUCTOR COMPONENT
2 RESIN LAYER
3, 30 INDUCTOR ELECTRODE
3*a*, 30*a* METAL PIN (FIRST AND SECOND COLUMN-SHAPED CONDUCTORS)
3*b*, 30*b* CONNECTING CONDUCTOR
4 POSITIONING JIG
4*a* POSITIONING MEMBER
4*b* COVER MEMBER
5 ARRANGEMENT HOLE
5*a* POSITIONING MEMBER-SIDE ARRANGEMENT GROOVE
5*b* COVER MEMBER-SIDE ARRANGEMENT GROOVE
6 HOLDING PLATE
7 SUPPORT PLATE
PL DIVIDING LINE

The invention claimed is:

1. An inductor component comprising:

an inductor electrode consisting of a single first column-shaped conductor and a single second column-shaped conductor that form input and output terminals and a single U-shaped connecting conductor that connects one end of each of the first and second column-shaped conductors to each other, the inductor electrode arranged such that other ends of the first and second column-shaped conductors oppose each other; and a resin layer containing the inductor electrode such that other ends of the first and second column-shaped conductors are exposed, wherein the connecting conductor is a sheet of metal, each of the first and second column-shaped conductors is a single linear shaped metal pin, a height of the first column-shaped conductor is same as a height of the second column-shaped conductor when viewed in a direction perpendicular to a thickness direction of the resin layer and a diameter of the first column-shaped conductor is same as a diameter of the second column-shaped conductor when viewed in a direction parallel to a thickness direction of the resin layer, the resin layer has a single-layer structure, and the one ends of each of the first and second column-shaped conductors are respectively in direct contact with the single U-shaped connecting conductor by ultrasonic bonding.

2. The inductor component according to claim 1, wherein a plurality of the inductor electrodes are provided; and the plurality of inductor electrodes are arranged in a matrix within the resin layer.

3. The inductor component according to claim 1, wherein a plurality of the inductor electrodes are provided; and the plurality of inductor electrodes are arranged in a matrix within the resin layer.

4. The inductor component according to claim 1, wherein a connection resistance between the first and second column-shaped conductors and the connecting conductor bonded by the ultrasonic bonding is lower as compared to a case where the first and second column-shaped conductors and the connecting conductor are bonded by solder.

* * * * *